United States Patent [19]

Narisoko et al.

[11] Patent Number: 4,757,771

[45] Date of Patent: Jul. 19, 1988

[54] METHOD AND APPARATUS FOR STABLE COMBUSTION IN A FLUIDIZED BED INCINERATOR

[75] Inventors: Minoru Narisoko, Matsudo; Satoshi Inoue, Asaka, both of Japan

[73] Assignee: Ishikawajima-Harima Heavy Industries Co., Ltd., Tokyo, Japan

[21] Appl. No.: 5,177

[22] Filed: Jan. 20, 1987

[30] Foreign Application Priority Data

Jan. 21, 1986 [JP] Japan ..... 61-8945

[51] Int. Cl.[4] ..... F23G 5/00; F23G 7/00

[52] U.S. Cl. ..... 110/245; 110/346

[58] Field of Search ..... 110/245, 346; 431/7; 122/4 D

[56] References Cited

U.S. PATENT DOCUMENTS

| | | | |
|---|---|---|---|
| 4,295,817 | 10/1981 | Caplin et al. | 432/15 X |
| 4,377,119 | 3/1983 | Noack | 110/346 |
| 4,397,267 | 8/1983 | Fink | 110/245 X |
| 4,506,631 | 3/1985 | Phong-Anant | 110/245 X |
| 4,543,894 | 10/1985 | Griswold et al. | 110/245 X |
| 4,552,203 | 11/1985 | Chrysostome et al. | 122/4 D X |
| 4,646,661 | 3/1987 | Roos et al. | 110/245 |

*Primary Examiner*—Edward G. Favors

*Attorney, Agent, or Firm*—Cullen, Sloman, Cantor, Grauer, Scott & Rutherford

[57] ABSTRACT

A method of combustion and a fluidized bed incinerator for burning and decomposing refuse such as municipal wastes are disclosed. The refuse is fluidized together with a fluidizing medium such as sand and primary air, to form a fluidized bed where the refuse is burned and decomposed. The pyrolysis gas produce by thermal decomposition of the refuse is combusted with secondary air supplied to the incinerator. By controlling the temperature inside the fluidized bed so as to be maintained in the range from 520° to 650° C., stable combustion is achieved, despite changes in the volume of refuse added to the fluidized bed, and the unburned pyrolysis gas and smut densities in the exhaust gas are decreased. Temperature control is achieved by spraying water onto the fluidized bed. The combustion air ratio can be reduced because the refuse can be stably combusted, and the temperature of pyrolysis gas inside the combustion chamber can be maintained at a high level.

17 Claims, 4 Drawing Sheets

(PRIOR ART)

METHOD AND APPARATUS FOR STABLE COMBUSTION IN A FLUIDIZED BED INCINERATOR

FIELD OF THE INVENTION

This invention relates to a method and apparatus for incinerating substances such as municipal wastes and industrial wastes (called "refuse" hereinafter) inside a fluidized bed incinerator. More particularly, it is concerned with a method and apparatus for stable combustion in a fluidized bed incinerator.

BACKGROUND ART

Fluidized bed incinerators are known for burning and decomposing refuse such as municipal wastes. In the method of incineration/decomposition in a fluidized bed incinerator, refuse in burned while being fluidized in a fluidized bed. In order to improve combustion of the refuse in the fluidized bed, a fluidizing medium such as sand is fed together with the refuse to form the fluidized bed.

The typical type of fluidized bed incinerator is equipped with a plurality of air diffuser tubes or plates (called as "air diffusers" hereinafter) supplying air to the lower part of the incinerator body, and with a refuse feeding mechanism and a fluidizing medium feeding mechanism in the upper part thereof.

The refuse in burned while both the refuse and the fluidizing medium are deposited onto the air diffuser tubes or plates inside the incinerator body, where they are fluidized by primary air blown from the air diffusers.

The refuse, which may comprise municipal wastes, generally contains a variety of materials such as low calorie refuse such as food, high calorie refuse such as plastics and rubber, refuse such as shredded paper or chipped furniture, and refuse such as fragmented metallic or vitreous containers, bottles, or cans.

As the refuse is fed to the fluidized bed, the combustibles are burned, of which substances such as plastics undergo pyrolysis and generate various pyrolysis gases, while the incombustibles such as metals or glass remain unburned (called "combustion residue" hereinafter).

As the fluidizing medium is gradually fed to the fluidized bed, a moving bed of fluidizing medium is formed which descends as the fluidizing medium is continuously supplied. As the combustibles are burned and decomposed within the fluidized bed, the combustion residue flows out of the incinerator, together with the fluidizing medium, through the gaps among the air diffusers at the lower section of the fluidized bed. The fluidizing medium and the combustion residue are separated from each other, and the separated fluidizing medium is returned to the fluidized bed.

Secondary air is supplied to the upper section of the incinerator, where the generated pyrolysis gases are burned.

Because, in this type of fluidized bed incinerator, the sand which is used as the fluidizing medium and which is deposited onto the fluidized bed is oscillated while it descends and is heated, the agitation and dispersion of the refuse is promoted.

For this reason, the refuse deposited onto the fluidized bed is dispersed uniformly in the presence of the fluidizing medium, and is dried, ignited, burned and decomposed instantaneously. Further, the ashes and dust produced therein rise to upper section the incinerator and are collected by an electric precipitator.

Consequently, the refuse deposited onto the fluidized bed is disposed of almost completely, leaving behind some metallic, vitreous, or ceramic residue. The ratio of these substances to the refuse is usually 2%, meaning a fluidized bed incinerator can dispose of 98% of the refuse. A primary advantage of the fluidized bed incinerator is that the volume of combustion residue can be reduced to $\frac{1}{3}$ compared to a conventional mechanical incinerator, such as a stoker-type combustor.

A problem exists, however, with fluidized bed incinerators in that the refuse deposited onto the fluidized bed is burned and decomposed at a speed so high that the refuse cannot be stably combusted. The refuse has different caloric value depending on the particular content of the refuse, and it is often difficult to supply a constant volume of the refuse to the fluidized bed. For example, suppose that a large quantity of refuse is deposited onto the fluidized bed at once, that the refuse is burned and decomposed instantaneously and that a large amount of pyrolysis gas along with dust is then generated, simultaneously. In this instance, it is not only impossible to completely combust the resulting large amount of pyrolysis gas with secondary air inside incinerator but it is also difficult to collect all of the large amount of smut in the exhaust gas using the electric precipitator.

The principal object of this invention is to provide a method and apparatus for slowing the burning and decomposition of the refuse in the fluidized bed to achieve stable combustion.

Further, another object is to control the speed of the fluidized bed and to be able to carry out stable combustion despite the fluctuations in the volume of refuse deposited onto the fluidized bed.

An additional object of this invention is the provision of a method and apparatus for stable combustion for a fluidized bed incinerator which is capable of reducing the volume of air supplied for the combustion of the refuse and of maintaining the combustion temperature of pyrolysis at a high level in the combustion chamber.

SUMMARY OF THE INVENTION

In order to attain the various aforesaid objects, the present invention involves fluidizing both the fluidizing medium and the refuse with primary air in a fluidized bed incinerator, feeding the refuse and fluidizing medium to the fluidized bed, burning and decomposing the refuse inside the fluidized bed, combusting the pyrolysis gases with secondary air supplied to the upper section of the fluidized bed incinerator, separating the combustion residue from the fluidizing medium in the lower section of the fluidized bed, circulating the separated fluidizing medium back into the fluidized bed, and maintaining the temperature inside fluidized bed in the range from 520° to 650° C.

DESCRIPTION OF THE PREFERRED EMBODIMENT

Hereinafter, an example of the preferred embodiment of the method and apparatus for stable combustion in a fluidized bed incinerator according to the present invention is described with reference accompanying drawings.

Figure 1:
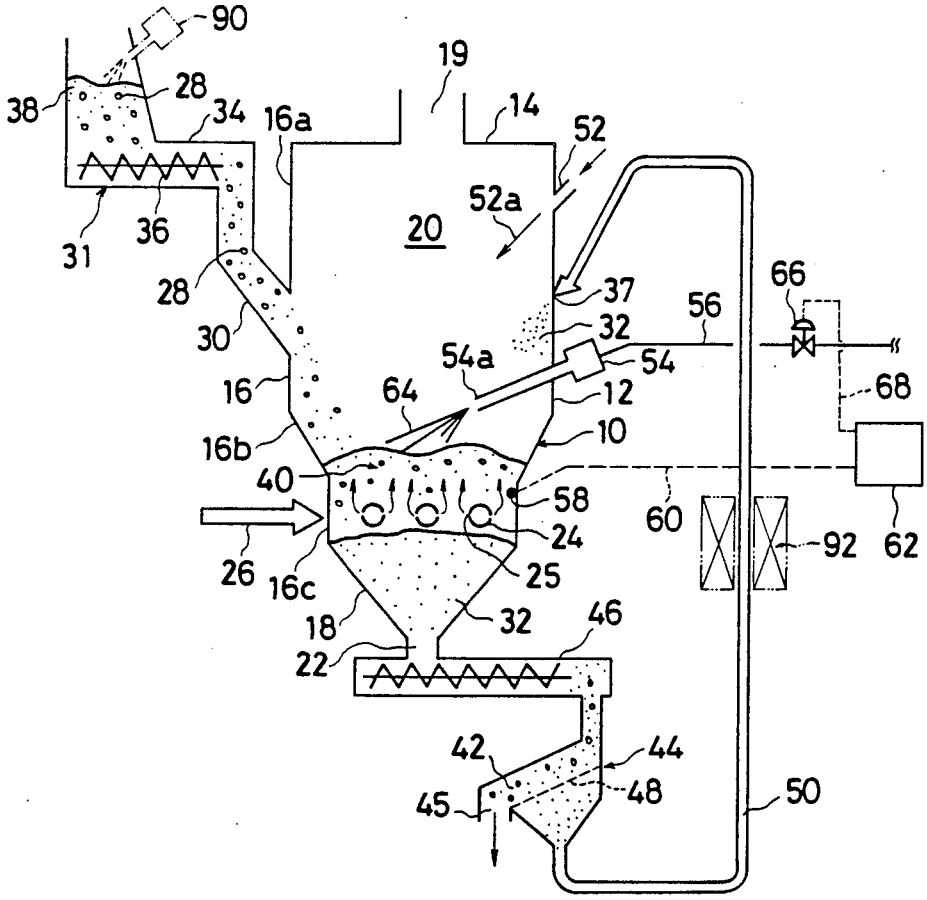
FIG. 1 is schematic sectional view of a fluidized bed incinerator according to the present invention.

In FIG. 1, the reference numeral 10 denotes an incinerator body made up of refractory walls 12, and comprising a rectangular top wall 14, side walls 16 and an inverted rectangular pyramidal bottom wall 18 connected to the lower section of the side walls 16.

The side walls 16 comprise an upper wall **16*a* in which a later described combustion chamber 20 is formed, a tilted wall 16*b* sloped inwardly from the upper wall 16*a*, and a vertical side wall 16*c* which extends vertically from the lower section of the tilted wall 16*b* and is also connected with the bottom wall 18. An exhaust port 19 is provided in the top wall 14, and a discharge port 22 is provided at the lower center of bottom wall 18**.

In the space enclosed by the vertical walls **16*c*, a large number of parallel air diffuser tubes 24 are provided to supply primary air in order to form the fluidized bed 40** described later.

The tubes 24 extend out through the vertical wall **16*c* of the incinerator body 10 and are connected to the fluidizing air charging tube 26. On either side of air diffuser tubes 24, longitudinal spaced holes 25 are provided in each tube 24**.

A duct 30 through which the refuge 28 is deposited onto the air diffuser tubes 24 is connected to the upper side wall **16*a* of incinerator body 10**.

A precipitator 31 is connected to the duct 30 and comprises a screw 36, and a casing 34 connected to the duct 30. The casing 34 has a hopper section 38 for the refuse 28. The refuse 28 introduced into the hopper 38 is transferred to the duct 30 by the rotation of screw 36, and is fed onto the air diffuser tubes 24 via the duct 30.

The upper wall section **16*a* of incinerator body 10 has a charging port 37 for feeding fluidizing medium such as sand into the incinerator body 10. This fluidizing medium 32 is deposited onto the air diffuser tubes 24 through the charging port 37** from a later described circulation unit.

The fluidized air charging tube 26, (indicated diagrammatically in the figure) is connected to an air charging source (not shown), to supply air to each air diffuser tube 24. Air supplied by the tube 26 comes out, as shown by the arrows in the figure, from each of the nozzle holes 25 of the air diffuser tubes 24. The refuse 28 along with the fluidizing medium 32 which is fed onto the air diffuser tubes 24 is fluidized by the air thus supplied, to form the fluidized bed 40.

A screw conveyor 46 is connected to a discharge port 22 of the incinerator body 10 to transfer to a separator, the fluidizing medium and the combustion residue which descends through the gaps between the air diffuser tubes 24.

The separator 44 contains a sieve 48 which separates the fluidizing medium 32 from the combustion residue 42. The combustion residue 42 remains on the sieve 48 and is discharged from a discharge port 45 of the separator 44. The fluidizing medium 32, after passing through the sieve 48, is fed back to the fluidized bed 40 via the charging port 37 through a circulation line 50 which may include, for example, a conveyor (not shown) which is connected to the separator 44.

Secondary air is supplied to the upper portion of the combustion chamber 20 of the incinerator body 10, by air intake nozzles 52 which are installed in the upper wall **16*a***.

A water spray 54 is provided which extends through the upper wall section **16*a* into the incinerator body 10 and includes an outlet tip 54*a* positioned above the fluidized bed 40. The spray 54 is connected to a water charging line 56**.

A temperature sensor 58 for sensing the temperature of the fluidized bed 40 is provided on the inside of the side wall **16*c*. The value detected by the sensor 58 is input to a control unit 62 through a signal line 60**.

A control valve 66 is connected to the water charging line 56, in order to regulate the volume of water 64 sprayed onto the fluidized bed 40 from the spray 54. Based on the temperature value detected by the temperature sensor 58, the control unit 62 controls valve 66 through a control signal line 68 so that the temperature of the fluidized bed 40 is maintained in the range from 520° to 650° C.

The method for burning the refuse in the fluidized bed incinerator will now be explained. The refuse 28 is fed onto the air diffuser tubes 24 inside incinerator body 10, via the duct 30 from the precipitator 31, and the fluidizing medium 32 is supplied through the charging port 37 from the circulation unit 50.

The fluidizing air is supplied to each air diffuser tube 24 from the fluidizing air charging tube 26, and the primary air is blown out, as shown by the arrows in figure, from each nozzle 25 of the air diffuser tubes 24.

The refuse 28 and the fluidizing medium 32 which are supplied onto the air diffuser tubes 24, are fluidized by the primary air blown in from the nozzles 25.

A number of start-up burners are provided inside the incinerator body 10 (not shown in the figure), for igniting the refuse 28 during initial start-up of the incineration operation. When combustion of the refuse 28 inside the fluidized bed 40 becomes sustained by the fluidizing air, the ignition by burners is terminated.

Some of refuse 28 undergoes pyrolysis and generates pyrolysis gas by the combustions heat of the refuse 28 inside the fluidized bed 40. The pyrolysis gas, containing $H_2$, CO and hydrocarbonaceous gases, is burned with the secondary air which is blown in, as shown by the arrow **52*a*, from the nozzles 52 in the combustion chamber 20, on the upper part of the inside of the incinerator body 10**.

The ratio of the primary air blown out of the air diffuser tubes 24 to the secondary air blown out of nozzles 52 is adjusted to a range of from 2:3 through 3:3, and preferably at 1:1, and further, the total air supplied is adjusted to be from 1.4 to 1.7 times the theoretical volume of air required for combusting the refuse.

The exhaust gas produced as a result of the combustion of refuse 28 and the pyrolysis gas are exhausted out of the incinerator through the exhaust port 19. This exhaust contains a large amount of heat and therefore can be utilized to preheat the water of boilers etc. Smut contained in the exhaust can be removed by an electrostatic precipitator after its use as a heat source.

The refuse 28 and the fluidizing medium 32 have to be timely fed to the fluidized bed 40 where the refuse is burned and decomposed, as discussed above. On the other hand, the fluidizing medium 32 promotes the agitation and dispersion of the refuse, and it also forms a moving bed descending through the fluidized bed 40. Thereafter, the fluidizing medium 32 flows down onto the bottom wall 18 along with the combustion residue 42 within the refuse 28, through the gaps between the air diffuser tubes 24, and forms a filling bed below the air diffuser tubes 24 with the fluidizing medium 32 and the combustion residue 42 contained therein. The filling bed helps adjust the thickness of fluidized bed 40 which is built up above the air diffuser tubes 24. As the combustion residue increases, the filling bed becomes larger and is discharged by the screw conveyor 46. The screw conveyor 46 transfers the fluidizing medium 32 and the combustion residue 42 to the separator 44.

In the separator 44, the combustion residue 42 is separated from the fluidizing medium 32 by the sieve 48, and is then discharged from the exhaust port 45, while the fluidizing medium 42 is returned to the fluidized bed 40 by the circulation line 50.

Normally, if the refuse 28 is burned in the fluidized bed 40 in the manner described above, the temperature of the fluidized bed may reach a level of from 700° to 800° C. However, in this temperature range, the combustion of refuse 28 occurs so quickly that such refuse is instantaneously dried, ignited, burned and decomposed. For this reason, if a large quantity of refuse 28 is introduced into the fluidized bed 40 at the same time, a large quantity of pyrolysis gas and smut will be generated. As a consequence, all the pyrolysis gas cannot be burned with the secondary air supplied into the combustion chamber 20, and the electric precipitator is not able to completely remove the dust from the smut contained in the exhaust gas.

In accordance with the present invention, therefore, the temperature of the fluidized bed 40 is detected by the temperature sensor 58, and the control unit 62 functions to regulate the control valve 66 and control the volume of water sprayed from the spray 54 so that the temperature of the fluidized bed 40 remains in the range from 520° to 650° C.

Since the fluidized bed 40 is maintained in the temperature range of from 520° to 650° C. by the water spray, the refuse 28 is burned and decomposed stably. Therefore, even if the volume of refuse 28 introduced into the fluidized bed 40 fluctuates, or a large amount of refuse 28 is introduced at the same time, stable burning and decomposition occur so that large quantities of pyrolysis gas and dust are not generated.

Further, the total ratio of air required for burning the refuse 28 to the theoretical air volume required to burn the refuse, which is conventionally 1.7 to 2.0, can be lowered to 1.4 to 1.7 according to this invention, and the temperature inside the upper portion (combustion chamber 20) of the incinerator can also be maintained at a high level.

Figure 2:
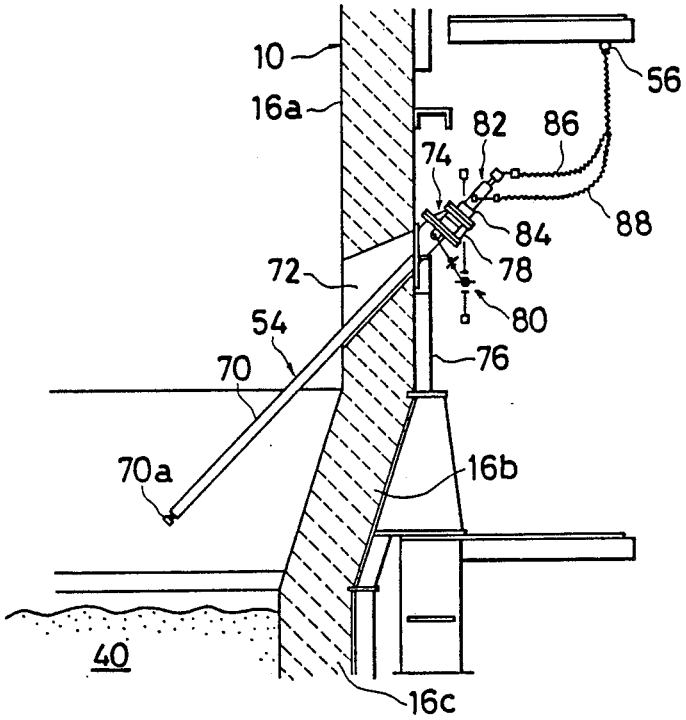
FIG. 2 is a fragmentary enlarged view of FIG. 1.

FIG. 2 shows the details of the water spray 54. The water spray 54 consists of a double tube 70, which is inserted at a downward angle from the insertion hole 72 that is provided on the upper section wall **16*a* of the incinerator body 10 and whose tip nozzle section 71 is positioned above the fluidized bed 40**.

The insertion hole 72 is cone-shaped and has smaller open end thereof positioned at the outer surface of the wall **16*a*. The insertion hole 72 allows the nozzle 70*a* on the tip of the double tube 70 to be moved to the right and left or up and down. The base 74 of the double tube 70 is supported, via a universal joint 78, on a supporting body 76 which is installed on the upper section wall 16*a*. The universal joint 78 is interlocked with linkage 80, and the nozzle 70*a* of the double tube 70 is moved up and down or right and left, via the universal joint 78, through movement of the linkage 80. The double tube consists of an inner tube 82 for water and an outer tube 84 for cooling air. The base of the inner tube 82 is connected, via a flexible tube 86, to the water supply line 56. The base of outer tube 84 is connected, via another flexible tube 88, to a cooling air supplying source (not shown in the figure). The flexible tubes 86 and 88 supply water and cooling air to the double tube 70 and are moveable along with the base of double tube 70**.

In the foregoing description, water is sprayed directly onto the fluidized bed 40 to keep the fluidized bed temperature in the range from 520° to 650° C., but it is to be understood that the water spray can be used to keep the temperature within other preselected temperature ranges.

Another means for keeping the temperature of the fluidized bed 40 in the range from 520° to 650° C. indicated in the phantom in FIG. 1, comprises a water spray 90 for spraying water into the hopper 38 of the precipitator 31, in order to thereby spray water onto the refuse 28 inside the hopper 38. In this alternative embodiment, the volume of the water from the spray 90 is adjusted so that the fluidized bed temperature sensed by the temperature sensor 58 is maintained in the range of from 520° to 650° C.

Because the temperature of the fluidizing medium 82 which is separated by separator 44 and circulated to the fluidized bed 40 through the circulation line 50 is at a relatively high level, the circulation line 50 is provided with a cooling unit 92 for cooling the fluidizing medium 32 supplied to the fluidized bed 40 through the circulation line 50, so that the bed temperature is maintained below 650° C.

The fluidized bed temperature can also be maintained below 650° C. by cooling the fluidizing air which passes through the air diffuser tubes 24 and the fluidizing air tube 26.

Further, the various means for temperature control described above can be combined for controlling the fluidized bed temperature.

Figure 3:
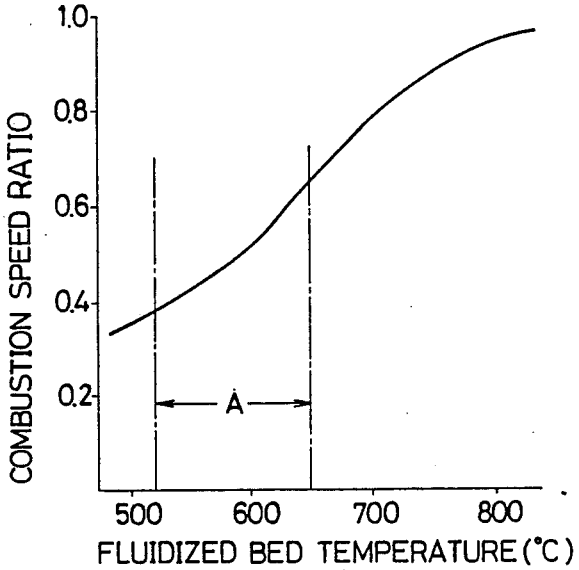
FIG. 3 is a graph showing the relation between the temperature of the fluidized bed and the combustion speed ratio of the refuse, according to the present invention.

FIG. 3 is a graph showing the relation between the temperature of the fluidized bed and the combustion speed ratio where the combustion speed ratio is the ratio of the minimum time needed for burning and decomposing the refuse under ideal conditions to the actual time required after the refuse is introduced into the incinerator.

As can also be seen from FIG. 3 when the fluidized bed temperature is in the range of from 700° to 800° C., its combustion speed ratio is 0.7 to 1.0, but this speed ratio can be maintained in the range of from 0.4 to 0.6 by keeping the temperature in the range "A", i.e., from 520° to 650° C. in accordance with the present invention, and it is possible to lower the speed ratio to about 60% of the conventional combustion speed ratio.

By burning the refuse slowly in this manner on the fluidized bed, the refuse is prevented from being burned instantaneously, and the voluminous generation of pyrolysis gas and smut can be suppressed.

It is undesirable that the temperature of the fluidized bed be lower than 520° C., because the combustion of the refuse in fluidized bed then becomes unstable (difficult), and a temperature higher than 650° C., is also undesirable because the combustion speed becomes higher and the volume to be decomposed and the volume of smut generated are instantaneously increased even if the changes in the volume and quality of the refuse are relatively small.

Figure 4:
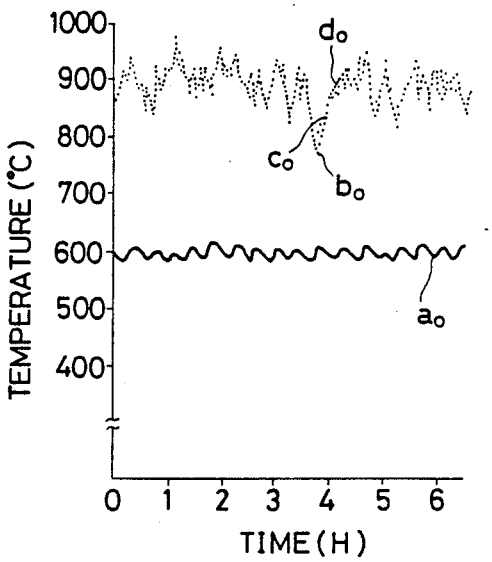
FIG. 4 is a graph showing the temperature of the fluidized bed and the chronological change of exhaust gas temperatures inside the incinerator when the refuse is burned according to the present invention.
Figure 6:
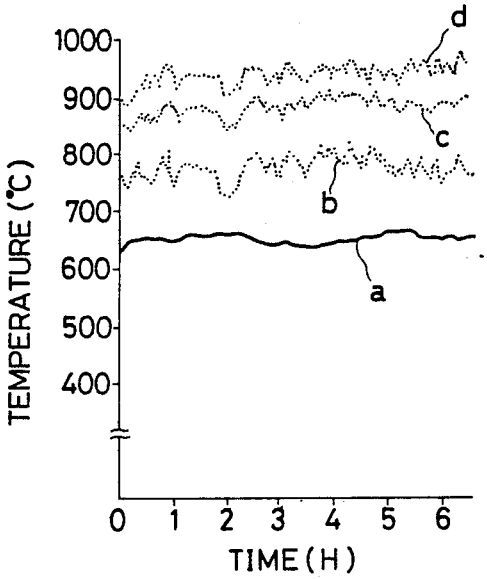
FIG. 6 is a graph shown the temperature of the fluidized bed and the chronological change of exhaust gas temperatures at several locations in the incinerator when the refuse is burned in accordance with the conventional method.

FIG. 4 and FIG. 6 compare the chronological changes of fluidized bed temperature and combustion gas temperature for the present invention and the prior art, respectively.

In connection with the graphs shown in FIGS. 4 and 6, the same fluidized bed incinerator was used and the temperature was measured for 6 or 7 hours, feeding municipal wastes at 2.5 tons/hour. The results shown in FIG. 4 reflect the carrying out of secondary combustion in the combustion chamber in addition to the temperature control of the fluidized bed in accordance with the present invention.

As shown in FIG. 6, since the temperature inside the fluidized bed is not controlled in the prior art method of operation, it can be seen that the fluidized bed temperature reaches a level higher than 650° C. The temperature gradually increases above the bed with the temperature in the lower section of the combustion chamber, i.e., temperature 'b' being around 750° C., the temperature in the upper section, i.e. temperature 'c' being around 850° C., and the temperature of combusted gas leaving the incinerator and entering into the gas cooling unit, i.e., temperature 'd' being around 950° C.

This means that the pyrolysis gas generated by the thermal decomposition in the fluidized bed is burned until it enters the gas cooling unit, and that the temperature inside the combustion chamber is low, around 800° C., and that the pyrolysis gas has not been completely burned.

In contrast, in connection with the present invention as shown in FIG. 4, it can be appreciated that when water is sprayed onto the fluidized bed and its fluidized bed temperature "ao" is kept at 600° C. ±15° C., the lower section temperature "bo" of incinerator, the upper section temperature "co" as well as the temperature "do" at the entrance of the gas cooling unit are all maintained at the relatively high level of around 900° C. It may also therefore be appreciated that the combustible gas which is generated is completely burned by the secondary air inside the combustion chamber.

Figure 5:
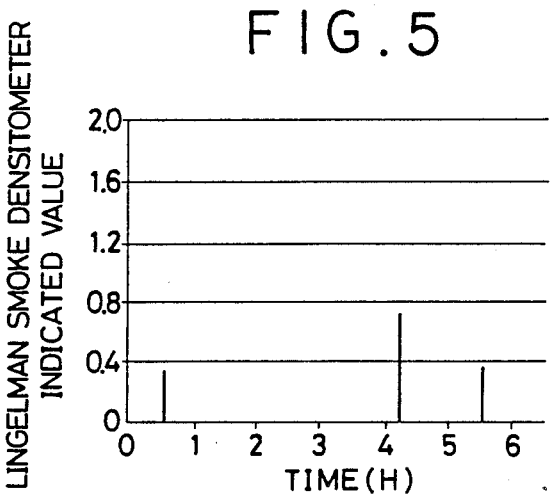
FIG. 5 is a graph shown the condition of smut generated within the exhaust gas after burning the refuse in accordance with the present invention.
Figure 7:
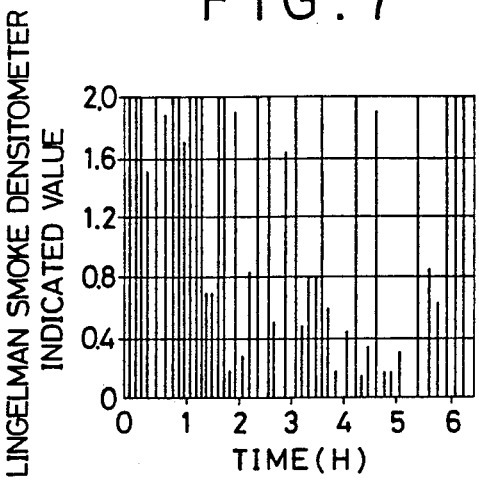
(PRIOR ART) FIG. 7
FIG. 7 is a graph showing the condition of exhaust gas generated when the refuse is burned according to the conventional method.

FIGS. 5 and 7 are graphs showing the smut concentration of exhaust gas from the stack, after the exhaust gas passes through the cooling unit and dust is removed by the electric precipitator, which is then measured chronologically by a Ringelman smoke density indicator.

In the case of the prior art (conventional) example described above, smoke having a Ringelman smoke indicator value of more than about 0.5 (the critical point for vision) is discharged relatively consistently as shown in FIG. 7, but in connection with the present invention, little smoke with an indicated value of more than 0.5 is emitted, as shown in FIG. 5.

It should be expressly understood that the present invention is not limited to the particular aforementioned embodiment. For instance, when controlling the temperature of the fluidized bed, its temperature can be controlled to the desired range by spraying water at a constant rate onto the refuse without detecting the temperature.

It will be appreciated from the foregoing description that the present invention provides the following results and advantages:

(1) By keeping the temperature of the fluidized bed in the range of from 520° to 650° C., the refuse can be slowly burned and stable combustion can be carried out without being affected by changes in the volume or quality of the refuse.

(2) Since the refuse is burned and decomposed slowly, pyrolysis gas or smut is not output in large amounts.

(3) Because the air ratio for combustion can be reduced, the combustion chamber temperature inside incinerator can be high and the secondary combustion of pyrolysis gas can be carried out under favorable conditions.

We claim:

1. A method of stable combustion of refuse in a fluidized bed incinerator, comprising the steps of:

(a) forming a fluidized bed in the incinerator by fluidizing said refuse to be incinerated and an incombustible fluidizing medium as said refuse and the fluidizing medium are supplied to the fluidizing bed along with primary air, the primary air being blown into the fluidized bed by air diffuser tubes provided in the lower part of the incinerator, the air diffuser tubes extending generally parallel to each other;

(b) burning and decomposing said refuse in said fluidized bed, the decomposition of said refuse resulting in the generation of pyrolysis gas;

(c) combusting said pyrolysis gas with secondary air supplied to an upper section of said incinerator;

(d) forming a downward flow of the combination of the combustion residue of said refuse and the fluidizing medium inside the fluidized bed through the air diffuser tubes, and discharging said combination from the bottom of the incinerator;

(e) separating the fluidizing medium from the combustion residue in a sieve;

(f) circulating the fluidizing medium separated in step (e) back to said fluidized bed; and (g) maintaining the fluidized bed temperature in the range from 520° to 650° C. by spraying water onto the fluidized bed.

2. The method of claim 1, wherein said fluidizing medium consists of sand.

3. The method of claim 1, wherein step (g) is performed by sensing the fluidized bed temperature and spraying water onto said fluidized bed.

4. The method of claim 1, wherein the total volume of the primary air and secondary air is from 1.4 to 1.7 times the theoretical volume of air required to combust said refuse.

5. The method of claim 4, wherein the ratio of the volume of the primary air to that of the secondary air is approximately 1:1.

6. A method performing stable combustion of refuse in a fluidized bed incinerator, comprising the steps of:

(a) forming a fluidized bed in said incinerator by fluidizing said refuse and a fluidizing medium with primary air;

(b) burning and decomposing said refuse in said fluidized bed; and (c) controlling said fluidized bed temperature so as to maintain said temperature in the range from 520° to 630° C. by applying water onto said fluidized bed.

7. The method of claim 6, wherein step (c) is performed by spraying said water onto said fluidized bed.

8. The method of claim 6, wherein step (c) is performed by mixing said water with said refuse and introducing refuse having said water mixed therein into said fluidized bed.

9. The method of claim 6, including the steps of separating the combustion residue of the refuse from the fluidizing medium in the lower part of said fluidized bed, and circulating the separated fluidizing medium back to said fluidizing bed, and wherein step (c) is performed by cooling the fluidizing medium circulated back to said fluidized bed.

10. A fluidized bed incinerator having a fluidized bed for combusting refuse, comprising:

an incinerator body;

a plurality of parallel air diffuser tubes in a lower section of said body, each of said tubes having a plurality of openings on opposite sides thereof for supplying primary combustion air to said fluidized bed;

means for supplying said primary combustion air to said tubes;

means for introducing refuse onto said fluidized bed above said tubes, the thermal decomposition of said refuse inside fluidized bed resulting in the generation of pyrolysis gas;

means below said tubes for removing combustion residue and a fluidizing medium from said lower section of said incinerator body;

means for separating said combustion residue from said fluidizing medium;

means for circulating the separated fluidizing medium back to said fluidized bed; and means for spraying water onto the upper face of said fluidized bed to control said fluidized bed temperature, said water spraying means having at least one nozzle which has changeable orientation and which produces an essentially uniform spray of water over said bed.

11. The fluidized bed incinerator of claim 10, including a temperature detector for detecting the fluidized bed temperature, and wherein said water spraying means is responsive to said temperature detector for controlling the volume of water sprayed onto said fluidized bed in accordance with the value of the detected temperature.

12. The fluidized bed incinerator of claim 10, wherein said water spraying means includes a double tube having an inner tube for spraying said water and an outer tube for air cooling said inner tube.

13. The fluidized bed incinerator of claim 12, wherein said double tube includes a water spraying tip and extends through said incinerator body, and said water spraying means includes a drive mechanism connected to said double tube for moving said spraying tip to spray water uniformly over said fluidized bed.

14. A fluidized bed incinerator having a fluidized bed for combusting refuse, comprising:

an incinerator body having an upper section and a lower section;

means for forming a fluidized bed in said lower section of said incinerator body using said refuse, a fluidizing medium and primary combustion air;

means for feeding said refuse to said fluidized bed; and means for spraying water including a water nozzle shiftably mounted on said incinerator body and means connected to said water nozzle for shifting said nozzle, in order to spray water essentially uniformly over said fluidized bed and to maintain the fluidized bed temperature within a preselected temperature range irrespective of the rate at which said refuse is fed to said fluidized bed by said refuse feeding means, whereby to achieve stable combustion of said refuse.

15. The fluidized bed incinerator of claim 14, wherein said water spraying means includes means for detecting the temperature of said fluidized bed and means responsive to the value of the temperature detected by said detecting means for controlling the volume of water to be sprayed over said fluidized bed by said water spraying means.

16. The fluidized bed incinerator of claim 14, wherein said water spraying means includes a double tube having an inner tube adapted to be coupled with a source of water for spraying water, and an outer air tube containing air for cooling said inner tube.

17. The fluidized bed incinerator of claim 14, including:

means for separating combustion residue of said refuse from the fluidizing medium derived from a lower portion of said fluidized bed; and means for circulating the separated fluidizing medium back to said fluidized bed, and wherein said temperature maintaining means includes means for cooling the separated fluidizing medium which is fed back to said fluidized bed.

* * * * *